United States Patent [19]

Staedeli

[11] 4,351,635

[45] Sep. 28, 1982

[54] DRIVE SYSTEM FOR MARINE VESSELS

[75] Inventor: Otto Staedeli, Menzingen, Switzerland

[73] Assignee: Maag Gear-Wheel & Machine Co. Ltd., Zürich, Switzerland

[21] Appl. No.: 80,187

[22] Filed: Oct. 1, 1979

[30] Foreign Application Priority Data

Oct. 13, 1978 [CH] Switzerland ..... 10644/78

[51] Int. Cl.[3] ..... B63H 23/10

[52] U.S. Cl. ..... 440/75; 74/665 L; 74/665 N; 74/DIG. 8

[58] Field of Search ..... 74/DIG. 2, DIG. 8, 665 L, 74/665 N, 665 M, 665 R; 440/75, 4, 3; 192/67 A

[56] References Cited

U.S. PATENT DOCUMENTS

| | | | |
|---|---|---|---|
| 2,229,544 | 1/1941 | Bauer | 440/75 |
| 3,056,314 | 10/1962 | Eichler et al. | 74/665 N X |
| 3,487,721 | 1/1970 | Burkhardt et al. | 74/665 N |
| 3,715,019 | 2/1973 | Heybourne | 192/67 A |
| 3,881,444 | 5/1975 | Sigg | 440/75 X |

FOREIGN PATENT DOCUMENTS

| | | | |
|---|---|---|---|
| 922749 | 1/1955 | Fed. Rep. of Germany | 440/4 |
| 380856 | 6/1940 | Italy | 440/75 |
| 1120941 | 7/1968 | United Kingdom . | |

*Primary Examiner*—Sherman D. Basinger
*Attorney, Agent, or Firm*—Werner W. Kleeman

[57] ABSTRACT

Both gas turbines of a drive system for marine vessels can be selectively connected by related first clutches with drive pinions and during so-called cruising travel, where only one drive unit or machine is operative, additionally via a gearing train with the related drive pinions. By means of speed reduction gearing the drive pinions drive two propeller shafts.

6 Claims, 5 Drawing Figures

DRIVE SYSTEM FOR MARINE VESSELS

BACKGROUND OF THE INVENTION

The present invention relates to a new and improved construction of a drive system for marine vessels containing two or more drive units or machines, especially gas turbines, two or more propellers and gearing which interconnects the propellers with one another and contains drive pinions which can be coupled, by means of a respective switchable clutch, with a respective one of the drive units.

Coastguard vessels and certain warships, such as frigates, equipped with two or more drive units or machines and two or more propellers, must be capable, on the one hand, during cruising travel, of driving both propellers by means of only one of the drive units and, on the other hand, when confronted with special situations or conditions, for instance during battle, must be capable of utilizing the completely available drive output of both or all of the drive units or machines. In this regard there must exist the possibility, during rapid change of the direction of travel, of adjusting the vanes of a propeller such that its power consumption is almost null and the totally available drive power or output is transmitted to any other selected propeller, for instance a propeller whose vanes have been set to have a correspondingly large pitch.

With a state-of-the-art drive system of the previously disclosed type, for instance as taught in British Pat. No. 1,120,941, especially FIGS. 3 and 4, two primary drive machines can be coupled, by means of a respective switchable clutch, with a respective drive pinion. These drive pinions drive, by means of a respective gear of a first gearing stage and a respective pinion fixedly connected therewith of a second gearing stage, a respective gear of the second gearing stage. The gears of the second gearing stage are connected, on the one hand, with a respective propeller and, on the other hand, by means of an intermediate gear and an intermediate pinion meshing therewith, with one another. The intermediate pinion is coupled by means of a third switchable clutch with an auxiliary drive machine. When both of the primary drive machines or units are operative, it can happen that one of them delivers power, by means of the closest situated gear of the second gearing stage, only to the therewith connected propeller, whereas the other primary drive machine likewise delivers power, by means of the closest situated gear of the second gearing stage, exclusively to the related second propeller. During the declutched condition of the auxiliary drive machine the intermediate pinion and the intermediate gear do not participate in the transmission of any drive power, rather only are loaded by torque fluctuations which randomly arise at the propellers. Owing to the unavoidable play between the unloaded tooth flanks it is possible for oscillations to arise at the prior art drive system, these oscillations no longer being controllable and can lead to undesired destruction of parts of the gearing system. It is even possible for loads to arise at the heretofore known drive systems, which the individual gear components only then can withstand if they are designed and dimensioned to be stronger than for taking-up the loads contemplated to be encountered during normal operation, if there occurs a sudden change in course with the full output of both primary drive machines in that one of the propellers is set for taking-up as little power as possible and the other is set for taking-up the maximum amount of power.

SUMMARY OF THE INVENTION

Therefore, with the foregoing in mind it is a primary object of the present invention to provide a new and improved construction of drive system for marine vessels which is not associated with the aforementioned drawbacks and limitations of the prior art construction discussed above.

Another and more specific object of the present invention aims at providing a new and improved construction of drive system of the previously mentioned type wherein there can be avoided dangerous oscillations in the gearing system and overload of individual gears for all travel conditions and manoeuvre operations of the vessel which might arise.

Now in order to implement these and still further objects of the invention, which will become more readily apparent as the description proceeds, the drive system of the present development is manifested by the features that each drive pinion is arranged between the switchable clutch associated therewith for connecting the drive pinion with the related drive unit or machine and a second switchable clutch. The gearing connection between both propellers is formed by two parallel gear trains. Each gear train is continuously connected with one of the drive units and can be coupled with the drive pinion of the other drive unit by means of its second switchable clutch.

Consequently, there are beneficially afforded different switching possibilities which will be explained more fully in conjunction with an example of a drive system containing two drive units and two propellers. First of all, just as was the case for the described state-of-the-art drive system, with the inventive drive system there exists the possibility that one of both drive units simultaneously drives both propellers, whereas the other drive unit is placed out of operation. Just as equally was the case for the heretofore known drive system there also is possible that both drive units drive both propellers, wherein, however, according to the invention and in contrast to the heretofore known drive system, there can be eliminated at the desired time the operating condition wherein each drive machine delivers output power only to the propeller operatively associated therewith, in that by appropriately switching the clutches the gearing connection, and thus, also the danger of oscillation transmission between both of the propeller shafts is interrupted. Finally, there is also present the possibility of selectively shutting down the one or the other propeller if it is no longer capable of being used because of, for instance, sea damage.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, the illustrated exemplary embodiment of drive system for a marine vessel will be seen to comprise a starboard (Stb)-drive unit or machine 10*a* which is continuously connected with a rear gearing train 12*a*. The starboard drive unit 10*a* can be coupled by means of a starboard side-first switching clutch 14*a* with a Stb-stepdown or speed reduction gearing 16*a* which, in turn, is continuously connected with a Stb-propeller 18*a*. In corresponding manner a portside or backboard (Bb)-drive unit or machine 10*b* is continuously connected with a front gearing train 12*b* and by means of a portside or backboard side-first switchable clutch 14*b* can be coupled with a Bb-stepdown or speed reduction gearing 16*b* which, in turn, is continuously connected with a Bb-propeller 18*b*. The Stb-speed reduction gearing 16*a* is additionally capable of being coupled with the front gearing train 12*b* by means of a starboard side-second switchable clutch 20*a*, whereas the Bb-speed reduction gearing 16*b* is capable of being coupled by means of a backboard side-second switchable clutch 20*b* with the rear gear train 12*a*. The aforementioned groups of components, which are operatively associated with the Bb-drive unit 10*b*, coincide with the corresponding groups of components which are operatively associated with the Stb-drive unit 10*a*, and therefore in the disclosure to follow it will suffice to describe in detail the last-mentioned group of components.

The rear gearing train 12*a* contains a first shaft 22*a* which is continuously connected with the Stb-drive unit 10*a*. Secured to the shaft 22*a* is a first gear train-pinion 24*a* which meshes, by means of a first gear train-gear 26*a* and a second gear train-gear 28*a* with a second gear train-pinion 30*a*. The second gear train-pinion 30*a* is attached to a second shaft 32*a* which is in alignment with the first shaft 22*b* of the front gear train 12*b*.

The switchable clutches 14*a* and 20*a* collectively form a clutch arrangement as the same has been described in detail in the commonly assigned U.S. patent application Ser. No. 956,040, filed Oct. 30, 1978, now U.S. Patent No. 4,274,523, issued June 23, 1981. The same is also true for the switchable clutches 14*b* and 20*b*. This clutch structure is shown in FIG. 3.

Figure 3:
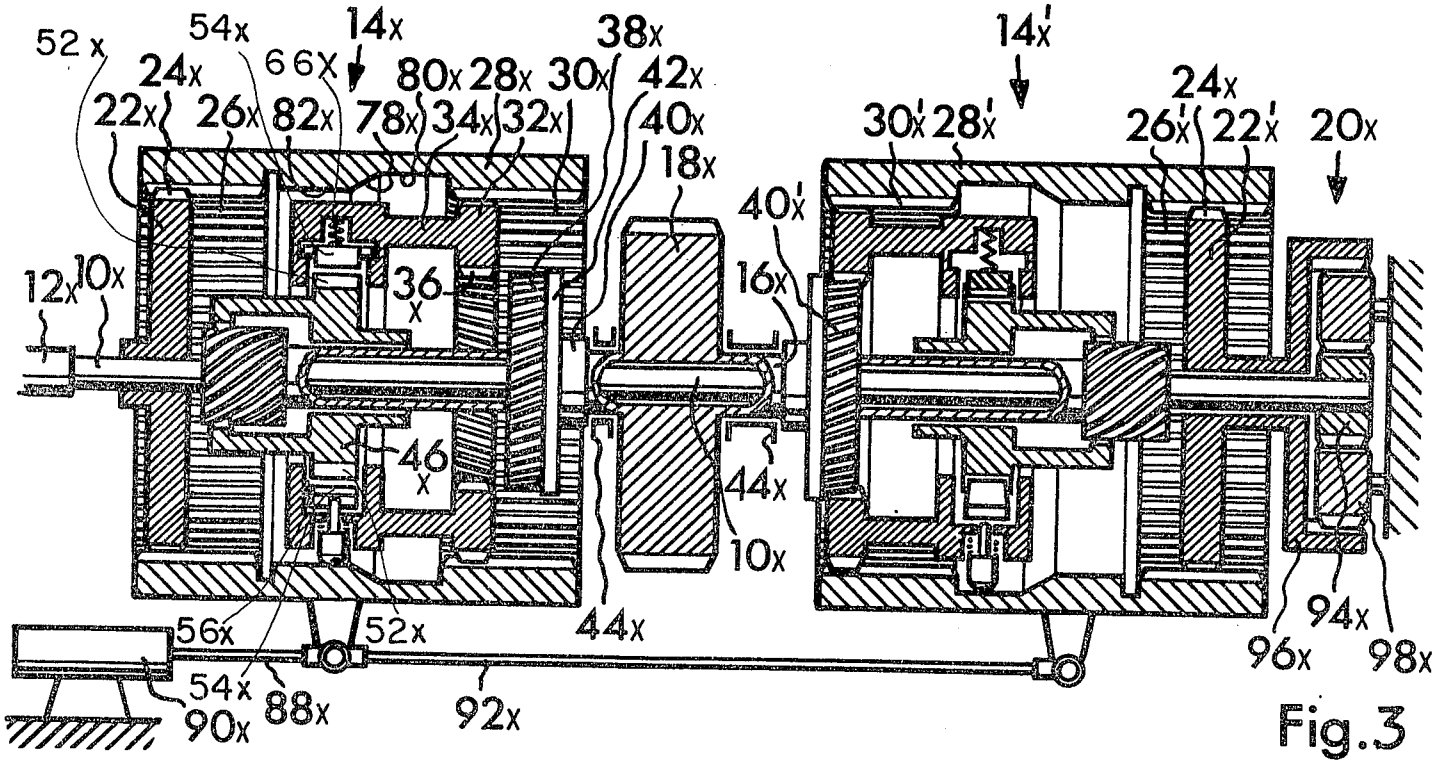
FIG. 3 is an axial sectional view through two coaxial tandemly arranged mutually symmetrical jaw clutches or gear couplings, of which the right-hand illustrated clutch is engaged whereas the left-hand illustrated clutch is disengaged and retained in its rest position.

FIG. 3 shows a drive shaft 10*x*, driven by any suitable drive unit or drive 12*x* which extends through two synchronous jaw clutches or gear couplings 14*x* and 14'*x* and a hollow and a hollow power turn-off shaft 16*x* having secured thereon a power take-off pinion 18*x* to reversing gear 20*x*.

The function of the jaw clutches 14*x* and 14'*x* is to selectively couple the drive shaft 10*x* directly or by means of the reversing gearing 20*x* with the power take-off shaft 16*x* so that the drive unit 12*x* with unchanged direction of rotation, can selectively drive the power take-off pinion 18*x* forwardly or rearwardly. Both of the jaw clutches 14*x* and 14'*x* are of essentially identical construction, however constructed to be mirror-image symmetrical. Their components are designated hereinafter with the same reference characters, except that those of the right-hand illustrated jaw clutch 14's have applied to the identical reference characters a prime marking and shall only be discussed in particular detail whenever the context of the disclosure so requires.

The jaw clutch 14*x* comprises a drive hub 22*x* which is attached to the drive shaft 10*x* and has an outer straight gear-tooth system or straight teeth 24*x*. The straight gear-tooth system 24*x* is in continuous engagement with a complementary straight gear-tooth system or straight teeth 26*x* formed at the inside of one end of an axially displaceable sleeve 28*x* and approximately three times as wide as the straight gear teeth 24*x*. The sleeve or sleeve member 28*x* possesses at its other end, at the inside thereof, a second straight gear-tooth system or straight gear teeth 30*x* which are continuously in meshing engagement with a complementary first gear-tooth system 32*x* or teeth means at the outside of a coupling or clutch star 34*x* which is rotatably mounted upon the power take-off shaft 16*x*. The mounting bearings for the clutch star have been conveniently omitted from the drawings to simplify the illustration. The clutch star 34*x* possesses at its inside a second gear-tooth system or teeth 36*x* which can be brought into engagement, by axial displacement of the clutch star 34*x*, with a complementary gear-tooth system or teeth 38*x* at a power take-off hub 40*x*. The gear-tooth systems or teeth 36*x* and 38*x* in the illustrated embodiment constitute, helical teeth. The helical motion, i.e., the thread-in motion, by means of which they can be brought into meshing engagement with one another, is limited by an annular or ring-shaped stop or impact member 42*x* which is formed at the power take-off hub 40*x*. This power take-off hub 40*x* is attached to the power take-off shaft 16*x* and fixedly held in axial direction by means of bearings 44*x* in which such is mounted.

Within the coupling or clutch star 34*x* there is mounted upon the hollow power take-off shaft 16*x* a screw socket or sleeve 46*x* in such a fashion that it can rotate in relation to the power take-off shaft 16*x* as well as in relation to the clutch star 34*x*, however, only is axially displaceable in conjunction with the clutch star 34*x* in relation to the power take-off shaft 16*x*.

At the outside of the screw socket 46*x* there is formed a pawl tooth system or ratchet 52*x* with which there is operatively associated a set of pawls 54*x*. The pawls 54*x* are mounted in a respective radially inwardly open recess 56*x* of the clutch star 34*x*. Each pawl 54*x* can be pre-biased by a compression or pressure spring 66*x*.

At the inner wall of the sleeve 28*x* there is formed a ramp or inclined surface 78*x* which, in turn, is limited by a radial outer cylindrical surface 80*x*, and, on the other hand, by a radial inner cylindrical surface 82*x*. The sleeve 28*x* and 28'*x* of both jaw clutches 14*x* and 14'*x* as shown in FIG. 3, are interconnected with one another by a connection rod 92*x* arranged as an extension of the piston rod 88*x* in such a fashion that during each actuation of the piston-and-cylinder unit 90*x* they carry out movements of the same magnitude in the same direction. Such movements of the sleeves 28*x* and 28'*x* in the same direction as viewed from the outside are, in fact, opposite movements in relation to the components or elements arranged internally of each of both sleeves 28*x* and 28'*x* owing to the mirror-symmetrical configuration of both jaw clutches 14*x* and 14'*x*.

The reversing gearing 20*x*, in the illustrated embodiment, comprises an internal central gear 94*x* attached to the drive shaft 10*x*, an external central gear 96*x* arranged coaxially with respect to the internal central gear 94x, and a set of stationarily mounted intermediate gears 98x, each of which meshes with both central gears 94x and 96x. The outer or external central gear 96x is fixedly connected with the drive hub 22'x of the jaw clutch 14'x.

With the switching state illustrated in FIG. 3—the left jaw clutch 14x assumes its rest position and is therefore ineffectual, whereas the right jaw clutch 14'x is engaged—the rotational moment of the drive unit 12x is transmitted to the power take-off shaft 16x by means of the drive shaft 12x and the reversing gearing 20x, the drive hub 22'x, the sleeve 28'x, the clutch star 34'x and the power take-off hub 40'x. The power take-off shaft 16x rotates opposite to the direction of rotation of the drive unit 12x, in other words rearwardly, if the rotational direction of the drive unit is designated as the forward direction, and this rearward rotation is accomplished owing to the incorporation of the reversing gearing 20x.

The Stb-speed reduction gearing 16a contains a drive shaft 34a which is aligned with the first shaft 22a of the rear gear train 12a and with the second shaft 32b of the front gear train 12b and interconnects both of the starboard side-switchable clutches 14a and 20a with one another. Attached to the drive shaft 34a is a drive pinion 36a which meshes with a gear 38a of a first gearing stage. The tooth width of the teeth 36 of the drive pinion 36a and that of the gear 38a is at least approximately twice as large as the tooth width of the teeth 24 and 30 of the gear train-pinions 24a and 30a and the tooth width of the teeth 26 and 28 of the related gear train-gears 26a and 28a and is dimensioned such that the drive pinion 36a is capable of at least transmitting the full power output of the Stb-drive unit 10a to the gear 38a. On the other hand, it is sufficient for the preferably provided drive system of the present invention, which will be described more fully hereinafter as to its mode of operation, if the gear train 12a is capable of transmitting one-half of the power output of the Stb-drive unit 10a and if the same holds true for the gear train 12b.

Furthermore, belonging to the Stb-speed reduction gearing 16a is a pinion 40a of a second gearing stage. This pinion 40a is fixedly connected with the gear 38a of the first gearing stage and meshes with a gear 42a of a further gearing or gear stage. The gear 42a is attached to a power take-off shaft 44a which is continuously coupled with the Stb-propeller 18.

Figure 1:
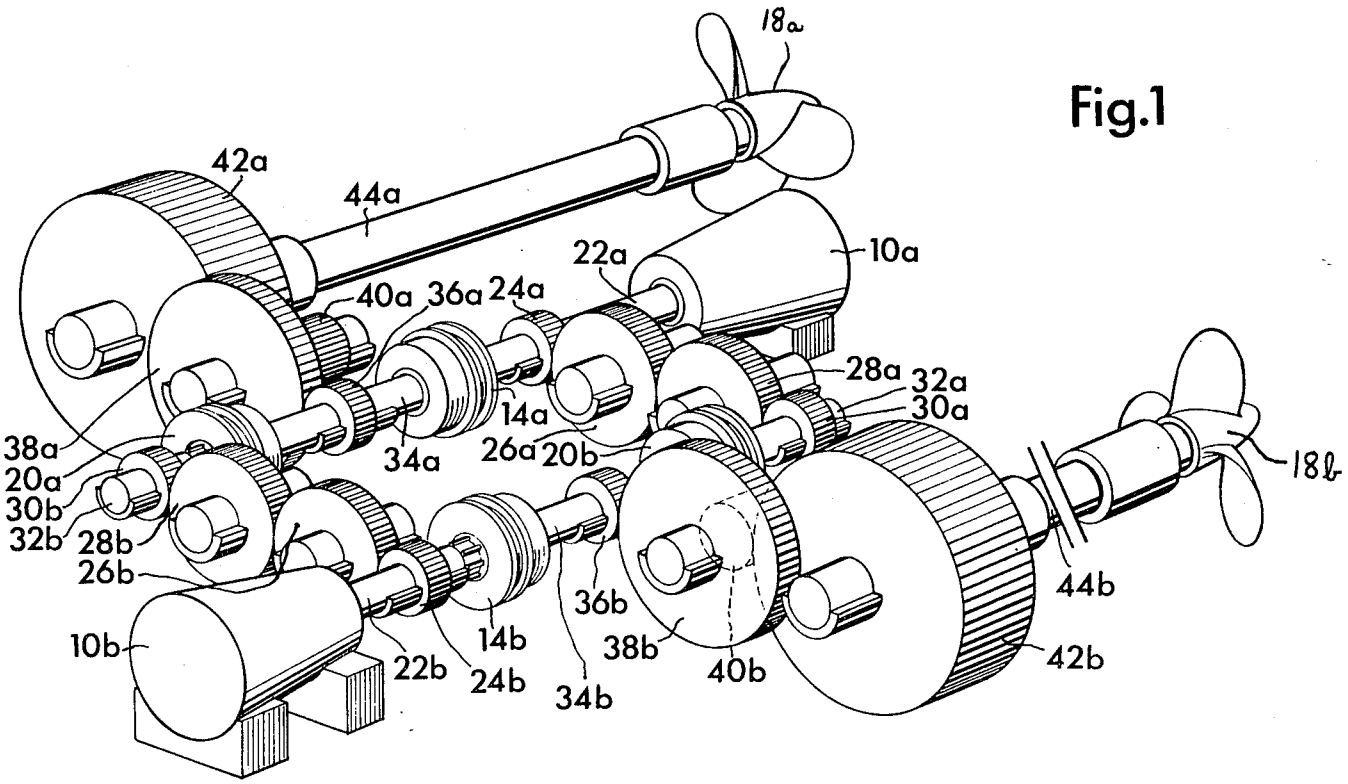
FIG. 1 is a perspective view of a drive system for a marine vessel and equipped with two drive units and two propellers.
Figure 2A:
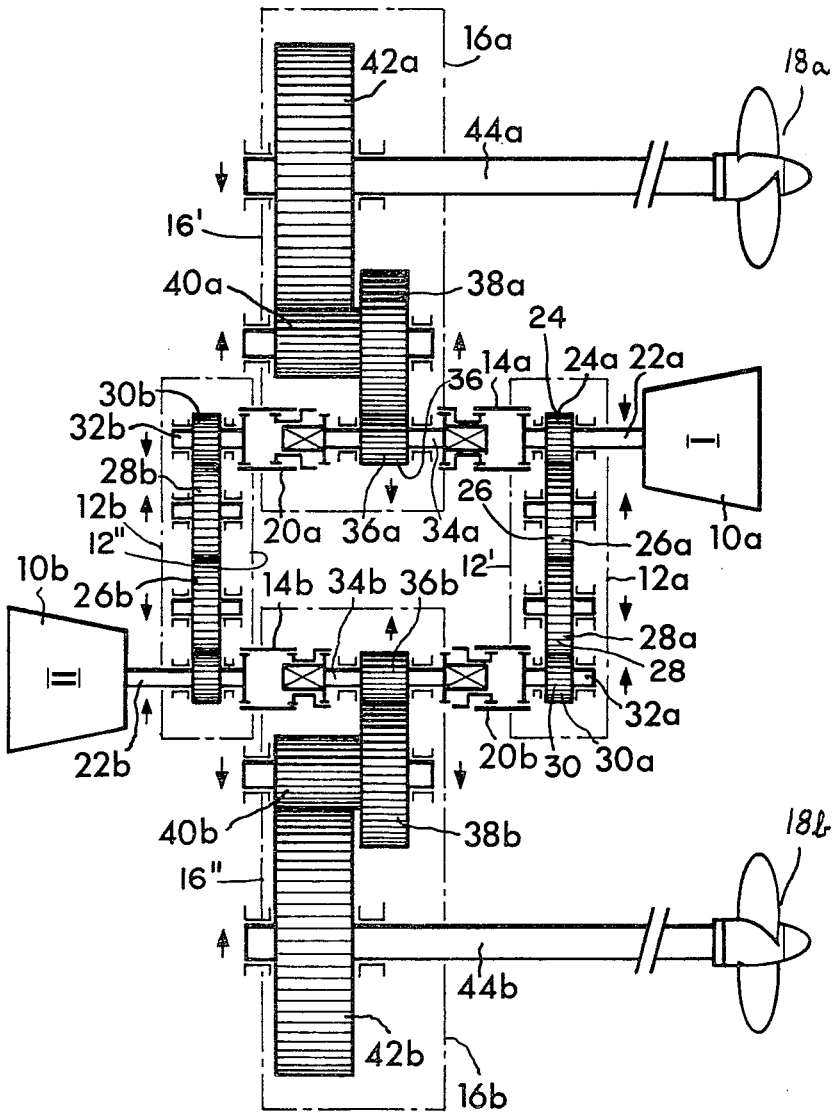
FIGS. 2*a*, 2*b* and 2*c* are fragmentary axial sectional plan views of the drive system showing different switching conditions thereof.
Figure 2B:
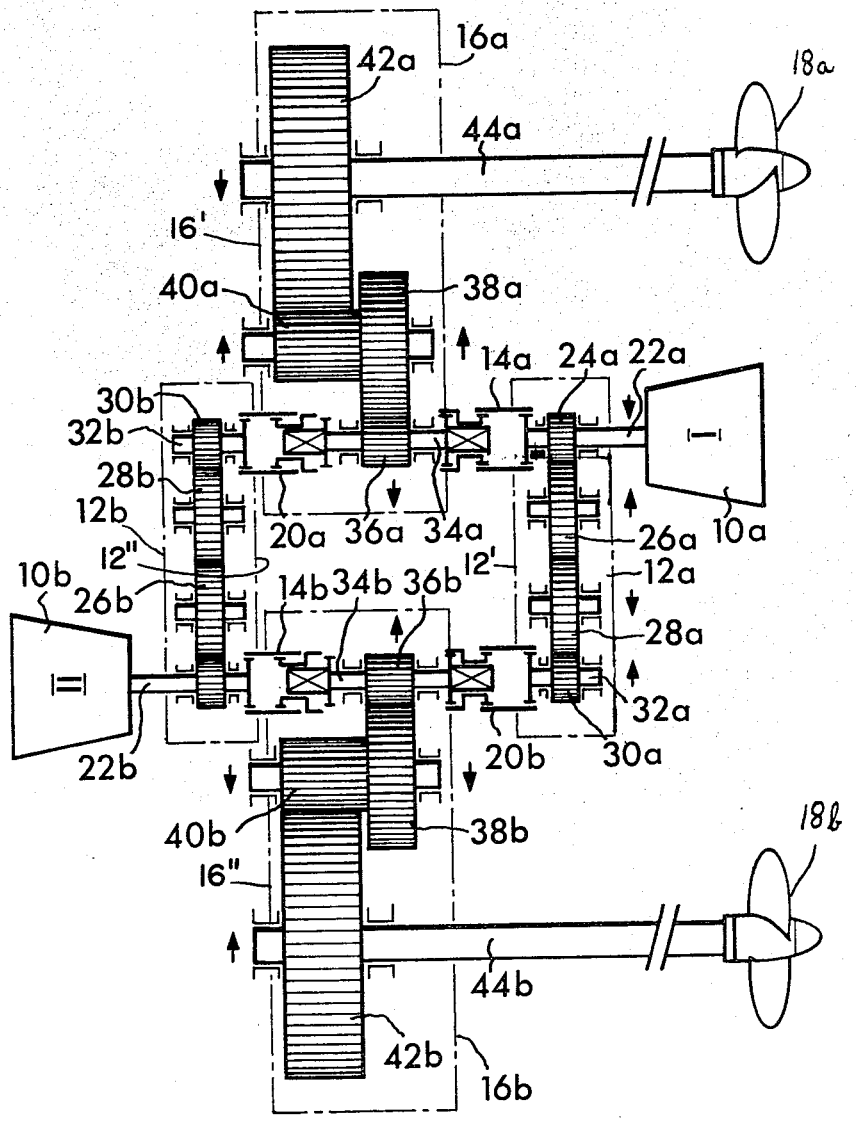
Figure 2C:
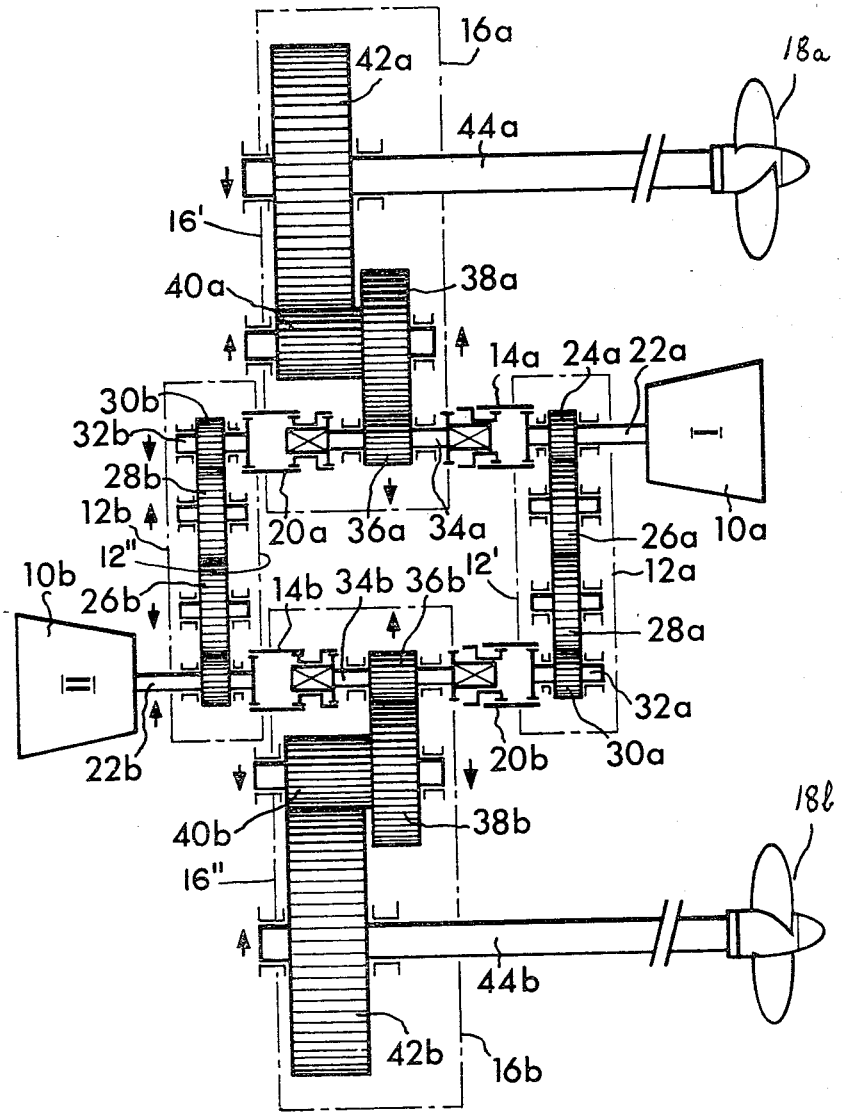

Each of both gearing trains 12a and 12b and each of both speed reduction gearing 16a and 16b possesses, as indicated with the chain-dot line of FIGS. 2a to 2c, its own gearing housing 12' and 12'' and 16' and 16''. Each of the aforementioned gearing or gearing systems therefore can be completely assembled together at the site of fabrication and then can be installed independently of the remaining gearing in a ship. During the subsequent installation of the gearing or gear trains 12a and 12b such are aligned with the speed reduction gearing 16a and 16b, and subsequently the drive units 10a and 10b are aligned with the gearing trains 12a and 12b. Any possibly existing alignment errors present between the shafts 22a and 34a and 32a and 34b and 22b and 34b and 32b and 34a, respectively, are compensated by the switchable clutches 14a and 20b and 14b and 20a, respectively. Relatively large alignment errors are then particularly permissible of such clutches are constructed as claw clutches.

FIG. 2a shows a switching state wherein the first starboard side-clutch 14a and the first backboard side-clutch 14b have been engaged, whereas the second clutches 20a and 20b are disengaged. With this switching state the Stb-drive unit 10a only drives the Stb-propeller 18a, whereas the Bb-drive unit 10b only drives the Bb-propeller 18b and there is no operative connection between both of the speed reduction gearings or gear systems 16a and 16b. Hence, oscillations which would affect the entire drive system, cannot be brought about either by randomly occurring fluctuations in the rotational speed of one of both drive units 10a or 10b nor by possibly occurring fluctuations of the power requirements of one of both propellers 18a or 18b. Both drive units 10a and 10b can be operated synchronously or asynchronously independently of one another and it is possible to adjust the propellers 18a and 18b, for instance one propeller being set to minimum power requirement and the other to maximum power requirement, without such causing overload of one of the gear trains leading to the propellers. With the switching state shown in FIG. 2a the pinions and gears of both gear trains 12a and 12b idle along, so that a certain power loss prevails, which however is of no great significance since, as experience has shown, this switching state only prevails for about 5% of the entire service life of the drive system.

FIG. 2b shows a switching state of the clutches 14a, 20a and 14b, 20b, where the Stb-drive unit or machine 10a is coupled with both of the propellers 18a and 18b, and specifically, with the Stb-propeller 18a in the manner described on the basis of FIG. 2a through the agency of the speed reduction gearing 16a, and on the other hand with the Bb-propeller 18b by means of the rear gear train 12a which, in turn, is coupled with the Bb-speed reduction gearing 16b. Bb-drive unit 10b and the front gearing train 12b are stationary. In this case there are no pinions or gears which rotate in an idle mode. The power output of the Stb-drive unit 10a is branched-off at the first shaft 22a of the rear gear train 12a. This is the reason that the pinions and gears of such gear trains preferably are dimensioned only half as strong as the drive pinion 36a and the gear 38a.

The same holds true for the switching state shown in FIG. 2c, wherein the Bb-drive unit 10b drives both propellers 18a and 18b, whereas the Stb-drive unit 10a together with the rear gear train 12a is stationary.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A drive system for a marine vessel comprising:
at least two drive units;
at least two propellers driven by said drive units;
a gearing system for operatively interconnecting the propellers with one another;
said gearing system comprising drive pinions;
a respective first switchable clutch for connecting one of the drive pinions with one of the related drive units;
a further respective second switchable clutch provided for each drive pinion;
each drive pinion being arranged between the first switchable clutch, operatively associated with said drive pinion for connecting such drive pinion with the related drive unit, and the further second switchable clutch;

said gearing system for interconnecting both of the propellers comprising two substantially parallelly arranged gear trains;

each gear train being continuously connected with a related one of the drive units; and each further switchable second clutch connecting the gear train of the related drive unit with the drive pinion of the other drive unit.

2. The drive system as defined in claim 1, wherein:

each of said gear trains comprises gears having a tooth width which is approximately half as large as the tooth width of the related drive pinion.

3. The drive system as defined in claim 1, wherein:

said switchable clutches comprise synchronous clutches;

each of said synchronous clutches containing a pawl blocking device for synchronization; and at least the pawl blocking device of the further clutches can be randomly rendered ineffectual.

4. A drive system for marine vessels containing two propellers, comprising:

a pair of gearing trains;

each gearing train serving to drive a related one of the propellers;

each gearing train being arranged in its own gearing housing;

a pair of gear systems each being provided with a related drive pinion for driving a related one of the propellers;

each gear system having gear elements driven by its related drive pinion; and each drive pinion together with the gear elements of the related gear system which serves to connect such drive pinion with the related propeller shaft, being mounted in a further gearing housing;

a respective drive unit for driving each propeller; and both of said propellers being drivable from any given one of the drive units even if one of said gear trains becomes inoperative.

5. The drive system as defined in claim 4, wherein:

each of said gear trains comprises gears having a tooth width which is approximately half as large as the tooth width of the related drive pinion.

6. The drive system as defined in claim 4, further including:

switchable clutches comprising synchronous clutches for operatively connecting each drive pinion with a related drive unit;

each of said synchronous clutches containing a pawl blocking device for synchronization; and at least the pawl blocking device of the further clutches can be randomly rendered ineffectual.

* * * * *